US005989120A

United States Patent [19]

Truchsess

[11] Patent Number: 5,989,120

[45] Date of Patent: Nov. 23, 1999

[54] ELECTRONIC COUNTING APPARATUS FOR A CHILD'S GAME AND METHOD THEREFOR

[75] Inventor: Joseph F. Truchsess, Ridgefield, Conn.

[73] Assignee: Pragmatic Designs, Inc., Port Chester, N.Y.

[21] Appl. No.: 09/227,106

[22] Filed: Jan. 7, 1999

Related U.S. Application Data

[60] Provisional application No. 60/070,642, Jan. 7, 1998.

[51] Int. Cl.[6] ..... A63B 23/035

[52] U.S. Cl. ..... 463/7; 463/36; 463/58

[58] Field of Search ..... 463/36, 37, 38, 463/6, 7, 58; 273/148 R, 148 B; 434/255, 307 R, 308

[56] References Cited

U.S. PATENT DOCUMENTS

| | | | |
|---|---|---|---|
| 3,717,345 | 2/1973 | Banville | 273/86 R |
| 3,834,702 | 9/1974 | Bliss | 273/86 B |
| 4,202,350 | 5/1980 | Walton | 128/690 |
| 4,334,190 | 6/1982 | Sochaczevski | 324/171 |
| 4,387,437 | 6/1983 | Lowrey et al. | 364/561 |
| 4,491,325 | 1/1985 | Bersheim | 273/148 |
| 4,578,769 | 3/1986 | Frederick | 364/565 |
| 4,613,139 | 9/1986 | Robinson, II | 273/148 |
| 4,616,829 | 10/1986 | Smack, Sr. et al. | 273/86 B |
| 4,772,028 | 9/1988 | Rockhold et al. | 273/311 |
| 4,925,189 | 5/1990 | Braeunig | 273/148 B |
| 5,086,404 | 2/1992 | Claussen | 364/559 |
| 5,090,708 | 2/1992 | Gerlitz et al. | 273/310 |
| 5,323,174 | 6/1994 | Klapman et al. | 345/156 |
| 5,430,435 | 7/1995 | Hoch et al. | 340/573 |
| 5,442,168 | 8/1995 | Gurner et al. | 250/221 |
| 5,542,672 | 8/1996 | Merideth | 463/37 |
| 5,568,928 | 10/1996 | Munson et al. | 463/37 |
| 5,591,104 | 1/1997 | Andrus et al. | 482/7 |
| 5,611,731 | 3/1997 | Bouton et al. | 463/37 |
| 5,672,107 | 9/1997 | Clayman | 463/36 |
| 5,702,323 | 12/1997 | Poulton | 482/8 |
| 5,751,273 | 5/1998 | Cohen | 345/156 |
| 5,865,624 | 2/1999 | Hayashigawa | 434/66 |

*Primary Examiner*—Valencia Martin-Wallace
*Assistant Examiner*—John Paradiso
*Attorney, Agent, or Firm*—Cohen, Pontani, Lieberman & Pavane

[57] ABSTRACT

An electronic game apparatus includes a wearable unit having a wearable housing configured for releasable attachment with a bodily part of a player. An inertia sensor affixed to the wearable housing detects oscillations imparted to the wearable housing and produces an output signal corresponding to each oscillatory movement. A counter, affixed to the wearable housing, counts each oscillatory movement imparted to the wearable housing.

8 Claims, 5 Drawing Sheets

ELECTRONIC COUNTING APPARATUS FOR A CHILD'S GAME AND METHOD THEREFOR

CROSS REFERENCE

This application claims the benefit of a prior-filed co-pending provisional application, Ser. No. 60/070,642, that was filed on Jan. 7, 1998.

BACKGROUND OF THE INVENTION

1. Field of the Invention

The present invention relates to electronic games and, more particularly, to an electronic game apparatus having a sensor and a counter attachable to a bodily part of a player for counting the number of times the player shakes the bodily part over a preselected interval of time.

2. Description of the Prior Art

There are known game apparatuses which provide competitive plays according to physical skills of a player. One popular game apparatus, typically found in an amusement park, includes a plurality of slidably mounted objects such as, for example, race horse figures. The game requires players to aim and shoot water into designated holes such that the more accurate is the player's aim, the further the corresponding race horse figure moves. Another popular game apparatus, also having slidably mounted model race cars, requires a player to drop as many ping pong balls as possible through a designated hole in a transparent plastic sheet, which then bounce into one of several openings in a wooden board below. Each of the openings in the wooden board corresponds to a different displacement value for the corresponding model race car. Thus, the player who can drop the greatest number of balls into openings with high displacement values will win the game.

SUMMARY OF THE INVENTION

An object of the present invention is to provide a low-cost electronic game apparatus for enabling two or more players to compete with each other by vigorously shaking a bodily part such as, for example, a hand or a leg, within a preselected play period.

Another object of the present invention is to provide a novel wearable unit that is releasably attachable to a bodily part of a player and which counts and records the number of times the bodily part is shaken over a period of time.

In one embodiment, the electronic game apparatus comprises a wearable unit which includes a wearable housing, an inertia sensor, and a counter. The housing is releasably attachable to a bodily part of a player. The inertia sensor produces a signal each time the bodily part is shaken. The counter counts the number of times the player shakes the bodily part by advancing one count each time it receives a signal from the inertia sensor. A user-manipulable switch and/or a user-selectable timer are provided to define a play period by starting or activating the counter at the beginning of the play period and stopping or deactivating the counter when the play period expires. A sound generator, responsive to an output signal of the counter, produces an audible tone each time the counter advances one count. The sound generator may also produce a music theme during the play period. In this embodiment, a wearable unit is provided to each player so that the players may simultaneously participate for the same predefined play period, thereby reducing the possibility of disagreements among the players over the duration of play. Each player's score, e.g. the number of times the player shakes or oscillates her wrist, may be ascertained at the end of the play period from a display on the housing attached to the counter. Alternatively, where only one wearable unit is available for play, each player may take turn wearing and shaking the wearable unit as rapidly as possible so as to achieve the highest count during her play period. The count or score for each player may be stored in a memory device, or manually recorded at the conclusion of her play period.

In another embodiment, the game apparatus includes a plurality of wearable units and a master or control unit. Each of the wearable units contains an inertia sensor, a sound generator, and a counter. The master unit contains a controller, connected to a timer in the master unit and to each of the wearable units, for synchronizing the activation and deactivation of the counters. The controller also outputs the scores to a display for viewing by the players. A data storage device responsive to the controller outputs audio data to a speaker for generating a play period defining music theme and video data to the display for generating images including the scores. The controller also includes circuitry for determining which of the players imparts to the respective bodily part the highest number of oscillations, the maximum rate of oscillations, etc. This embodiment is particularly advantageous in that all the counters start and stop synchronously with the beginning and end of the play period; that the start of the play period may be initiated automatically or, alternatively, by a spectator or a non-participating player; and that the end of the play period may be signified by the expiration of the music theme.

Other objects and features of the present invention will become apparent from the following detailed description considered in conjunction with the accompanying drawings. It is to be understood, however, that the drawings are included solely for purposes of illustration and should not be construed as limiting the scope of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
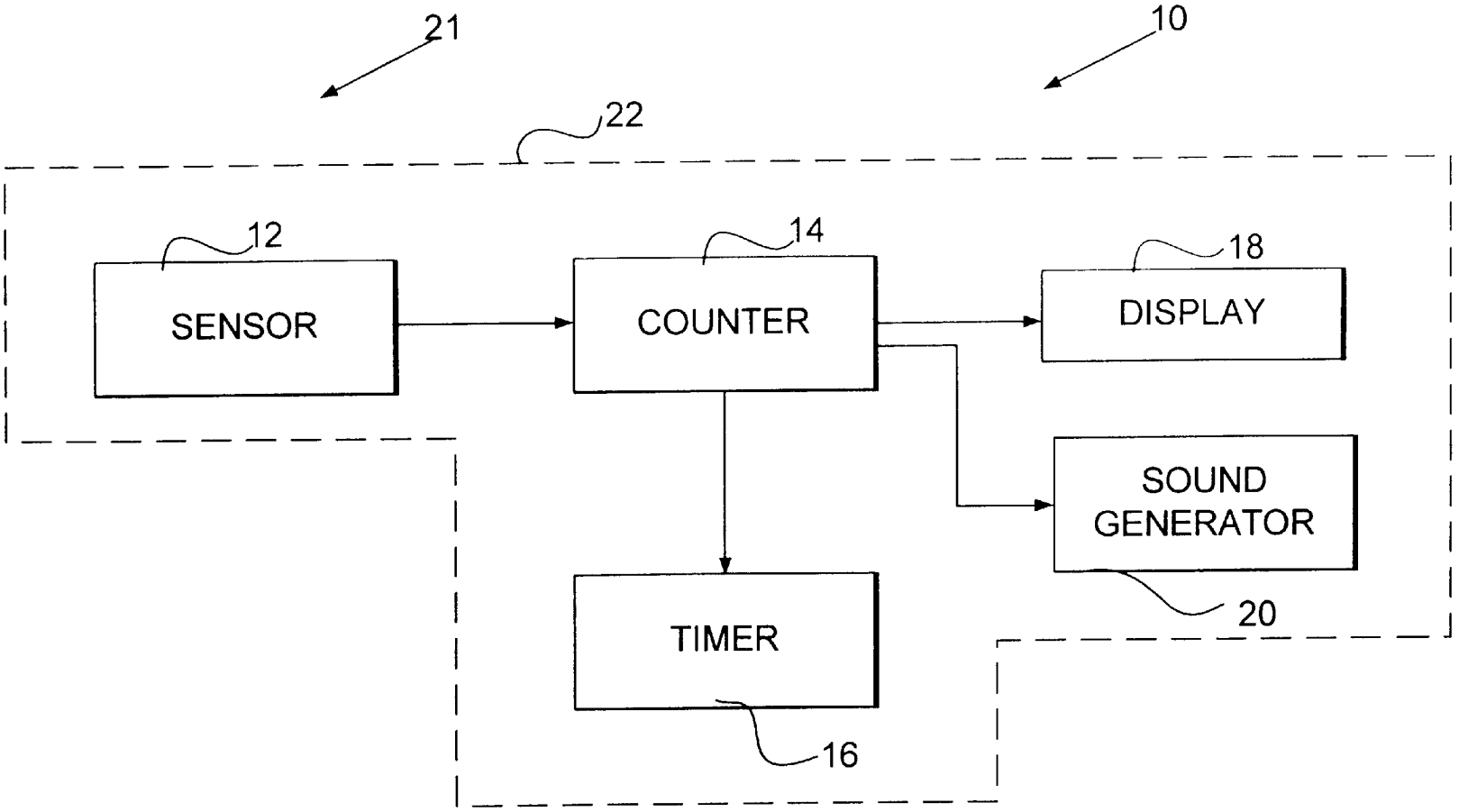
FIG. 1 depicts a functional block diagram of a first embodiment of an electronic game apparatus constructed in accordance with the present invention.

Referring now to the drawings, FIG. 1 diagrammatically illustrates a first embodiment of an electronic game apparatus 10 of the present invention. As shown, the apparatus 10 includes a sensor 12 for sensing oscillatory movements imparted to a bodily part (e.g., an ankle or wrist) of a player, and a counter 14 connected to the sensor 12 for counting the number of oscillatory movements detected by the sensor 12 as by, for example, advancing one count for each oscillatory movement detected by the sensor 12. The counter 14 is preferably constructed to include a reset input for initializing the counter 14 to a value such as, for example, zero. The apparatus 10 further includes a timer 16 for defining a play period by starting and stopping the counter 14 and a display 18 for displaying information, such as the most current count value. The timer 16 is responsive to user commands so that the player or another can freely select the play period. A sound generator 20, connected to the counter 14, includes a speaker for outputting a tone each time the counter 14 increments its count.

All of the above-described components (i.e., the sensor 12, counter 14, timer 16, display 18, and sound generator 20) are preferably interconnected by a printed wiring board (not shown) so that the entire assembly can be conveniently affixed to a wearable housing 22. The wearable housing 22, configured for releasable attachment to a bodily part may include, for example, straps dimensioned to wrap around the bodily part and having complementary Velcro™ type surfaces for attachment. The housing 22 and the components mounted there at form a wearable unit 21.

Figure 2:
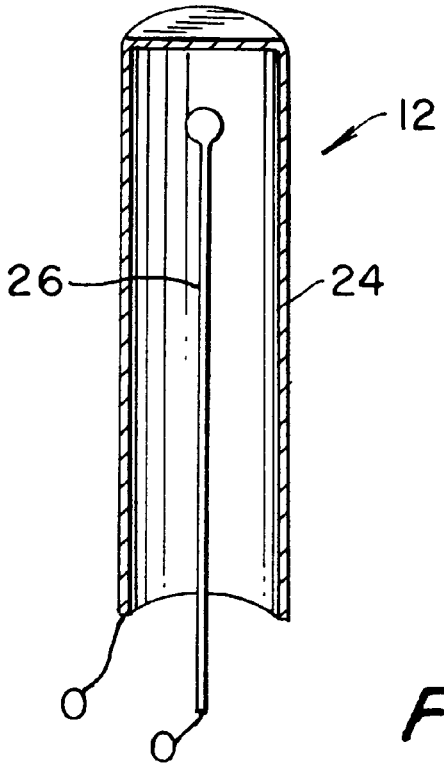
FIG. 2 depicts a sectioned view of an inertia sensor for the first embodiment of FIG. 1.

As exemplarily illustrated in FIG. 2, the sensor 12 is preferably an inertia sensor and includes an electrically conductive cylindrical housing 24 and an electrically conductive, flexible deflection member 26. The sensor 12 has a disengagement position wherein the deflection member 26 is not in contact with the cylindrical housing 24 and an engagement position wherein the deflection member 26 contacts the cylindrical housing 24 by means of inertia. The cylindrical housing 24 or, alternatively, the deflection member 26, is electrically connected to a counter input while the other is connected to a voltage source such that when the cylindrical housing 24 and the deflection member 26 are in contact, i.e., when the sensor 12 is in its engagement position, the counter input attains the voltage level of the voltage source thereby causing the counter 14 to advance one count. The sensitivity of the sensor 12 may be varied by adjusting the free length and/or the cross-sectional geometry of the deflection member 26 so that the more flexible is the deflection member 26, the more sensitive is the sensor 12 and vice versa. The construction of the deflection member 26 can be readily realized by a person of ordinary skill in the art. It will be appreciated that the housing 24, being substantially cylindrical in shape, advantageously permits the deflection member 26 to contact therewith in a multitude of radial directions so that the sensor 12 can detect oscillatory movement in virtually any direction. It is contemplated that instead of inertia sensor, other art-recognized sensors such as, for example, mercury switches, may also be employed.

Figure 3:
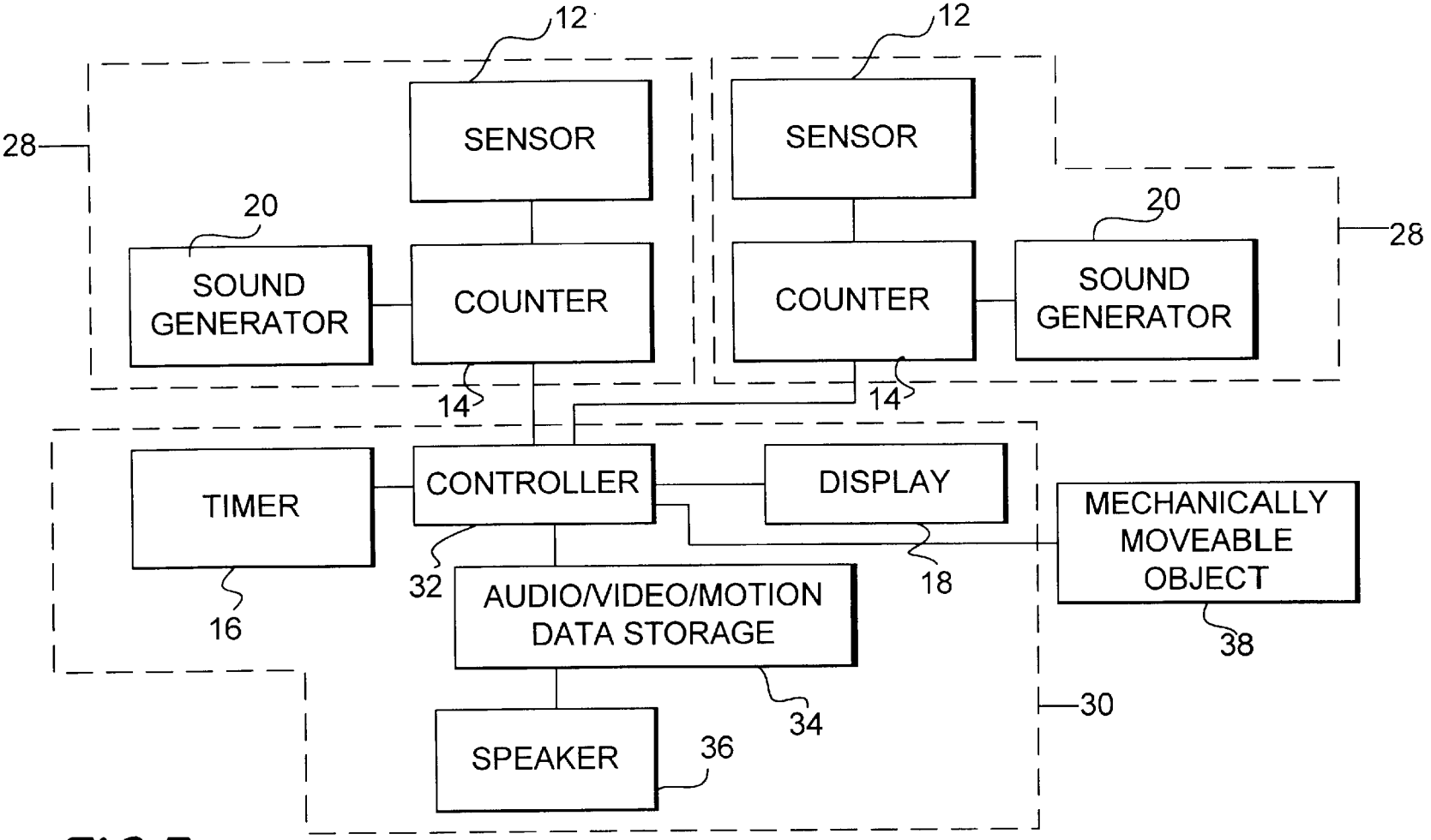
FIG. 3 depicts a functional block diagram of a second embodiment of the electronic game apparatus constructed in accordance with the present invention.

FIG. 3 diagrammatically depicts a second embodiment of the electronic game apparatus 10 which includes a plurality of wearable units 28 for group play and, particularly, head-to-head group play. In this embodiment, each of the wearable units 28 contains a counter 14, a sensor 12, and a sound generator 20 as described above. Unlike the first embodiment, however, each of the wearable units 28 does not include a timer 16 and a display 18. Rather, a single timer 16 is disposed in a separate housing 30, preferably a stationary, non-wearable one. A controller 32 such as, for example, a microprocessor is also disposed in the housing 30 and connected to the timer 16. The controller 32 is preferably configured to communicate with and to synchronize the activation of the counters 14 of the wearable units 28. A display 18 in the housing 30 is also connected to the controller 32 for displaying information such as, for example, the number of oscillations imparted to each wearable unit and/or other entertaining images. This embodiment further includes a data storage unit 34, connected to the controller 32, for storing audio data and/or video data. The audio data may consist of data representing, for example, a music theme to be outputted through a speaker 36 in a manner determined by the controller 32. In a particularly preferred embodiment, the audio data represent sounds of racing cars and the video data represent images of moveable objects, e.g., race cars—each of which corresponds to an individual player. The controller 32 is programmed such that the faster the player shakes her wearable unit 28 the faster the corresponding race car image travels or moves along, for example, a raceway image. In other words, movement of the race car image is proportional to the number or the rate of oscillations. This exemplary combination will provide a game that is fun and exciting for players of all ages.

Optionally, or in addition to the display 18, a mechanically moveable object 38 may be connected to the controller 32 and the data storage unit 34 also stores motion data representing, for example, incremental movement of the mechanically moveable object 38. The controller 32 includes an electromechanism for controlling movement of the moveable object 38 in accordance with the motion data and the number of oscillatory movements imparted to the wearable unit 28. The moveable object 38 may, for example, be a model race car slidably guided along a rail. So arranged, the model race car controllably moves along the rail in an amount proportional to, for example, the number of oscillations imparted by a player. Preferably, a plurality of moveable objects 38, e.g., model race cars, are provided for head-to-head play by multiple players such that each player or team of players can control movement of a corresponding model race car. Such collective effort by the players will add to the entertainment value of the inventive game apparatus.

Figure 4:
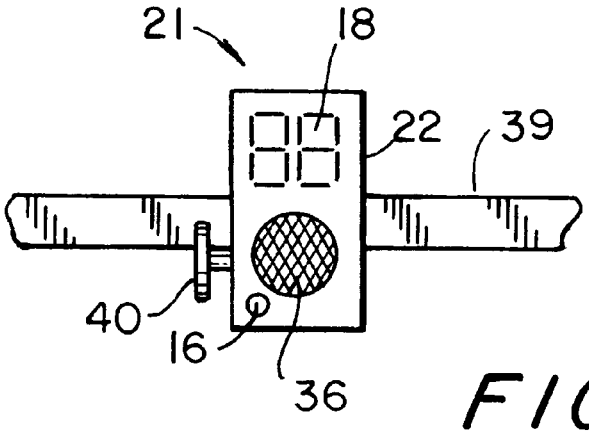
FIG. 4 is a schematic view of a wearable unit of the first embodiment of the present invention.

FIG. 4 is a schematic view of the wearable unit 21 of the first embodiment of the present invention. The wearable unit 21 includes attachment straps 39 and is intended for solitary or one-at-a-time play while simultaneous group play may be achieved by using a plurality of these units, one for each player. As shown, the wearable unit 21 includes a speaker 36, a display 18, and a pushbutton 40. The display 18 is preferably a light-emitting diode (LED) type display but may alternatively include a liquid-crystal display (LCD), or any other art-recognized visual display device. The display 18 provides a real-time visual indication of each player's score. At the end of each play period, the player's total score is presented via the display 18. The speaker 36 may audibly communicate a tone each time a player shakes the bodily part to which the wearable unit 21 is attached. The counter 14 of the wearable unit 21 is activated at the beginning of a play period and deactivated at the end of the play period by depressing the pushbutton 40. The play period may be defined by, for example, the duration of a song or by a preselected play period defined with reference to a watch or clock. If a song defines the play period it may be generated by wearable unit 21 and played over speaker 36 or it may be played by an external audio device, such as a CD player. Alternatively, the variable timer 16 may be used for selecting the duration of the play period, which may be synchronized with play of a musical theme by wearable unit 21 via speaker 36. When so provided, the wearable unit 21 is activated by depressing the pushbutton 40 and automatically deactivated upon expiration of the play period. This alternative is advantageous insofar as it minimizes disagreements among the players over the duration of play.

For group play with a single wearable unit 21, the wearable unit 21 may be worn successively by each player. Each player initiates his/her play period by depressing the pushbutton, with the duration of play preferably synchronized with play of a musical theme via speaker or an external audio source as described hereinabove. Alternatively, the play period may be defined solely by the variable timer 16, and in either event display 18 may also display the time remaining during the respective play period. If no music is played, wearable unit 21 preferably incorporates an audio and/or visual indication that the play period has expired. Whichever approach is employed, at the end of each play period the current player's total score is visible on the display 18 or audibly communicated by the wearable unit 21, and may be recorded as on a scorecard or stored in a memory in the wearable unit.

Where multiple wearable units 21 are available, play may proceed with each player wearing a separate wearable unit. Here, a play period is initiated by each player simultaneously depressing his/her respective pushbutton 40 and the play period may be terminated in any of the ways described hereinabove. Preferably, however, the play period is defined by the players via the variable timers 16 on their respective wearable units with each player setting his or her respective timer to define the same play period. Deactivation of the wearable units occurs automatically upon expiration of the play period as defined by the variable timer 16.

Figure 5:
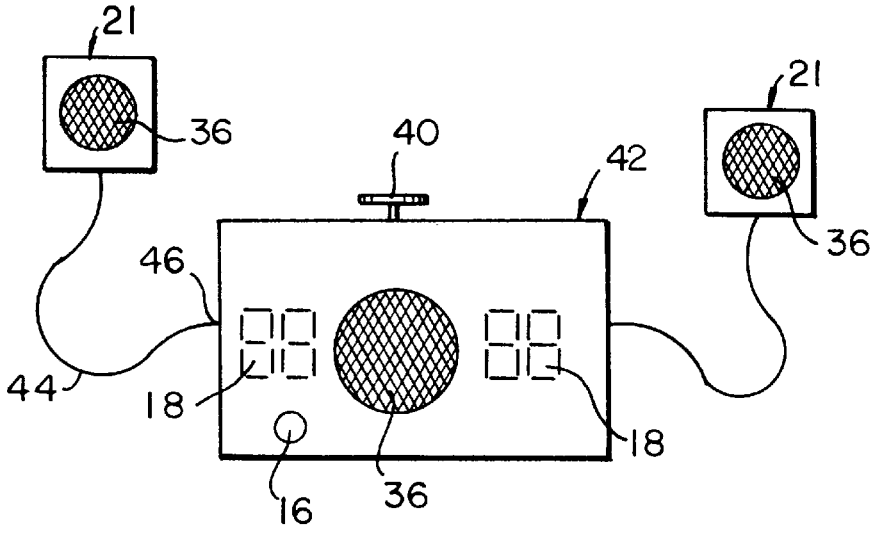
FIG. 5 is a schematic view of two wearable units and a master unit configured in accordance with the second embodiment of the present invention.

Referring next to FIG. 5, a second embodiment of the present invention is schematically depicted. A plurality of wearable units 21, each having a speaker 36, are electrically connected to a master unit 42 by cables 44 via connectors 46. Although FIG. 5 depicts only two wearable units 21 connected to the master unit 42, as will be readily apparent to those of ordinary skill in the art, more or less wearable units may be so connected. In lieu of cables 44, wearable units 21 may be connected to the master unit 42 by a wireless transmission system. The master unit 42 preferably includes a speaker 36 for producing theme music from audio signals transmitted via cables 44. The master unit 42 also includes a display 18. In this embodiment wearable units 21 may or may not include a separate sound generator, which, if included, could be automatically deactivated when a wearable unit 21 is connected via cable 44 to master unit 42. Master unit 42 also includes a pushbutton 40 for initiating a play period and a variable timer 16 for setting the duration of the play period. Alternatively, the timer 16 automatically activates wearable units 21 for a predetermined interval with actuation being indicated, for example, by commencement of play of the theme music or a visual indication by the display 18 which may be disposed at the wearable units 21 or master unit 42, or both.

In a preferred embodiment a play period selected by timer 16 is defined by theme music outputted by speaker 36, with the counters 14 of the wearable units 21 synchronously activated by depression of the pushbutton 40 and synchronously, automatically deactivated when the play period expires. An alarm may be generated by the sound generator 20 of the master unit 42 and communicated via the speaker 36 upon the beginning and/or expiration of the play period as defined by the timer 16. During the play period, the speakers 36 provided on the wearable units 21 may produce a sound each time the player shakes the bodily part to which the user-wearable housing 22 is attached, and the sound communicated by the separate speakers 36 may be the same or, preferably, different from each other. Alternatively, wearable units 21 may be further simplified by dispensing with speakers 36.

Figure 6:
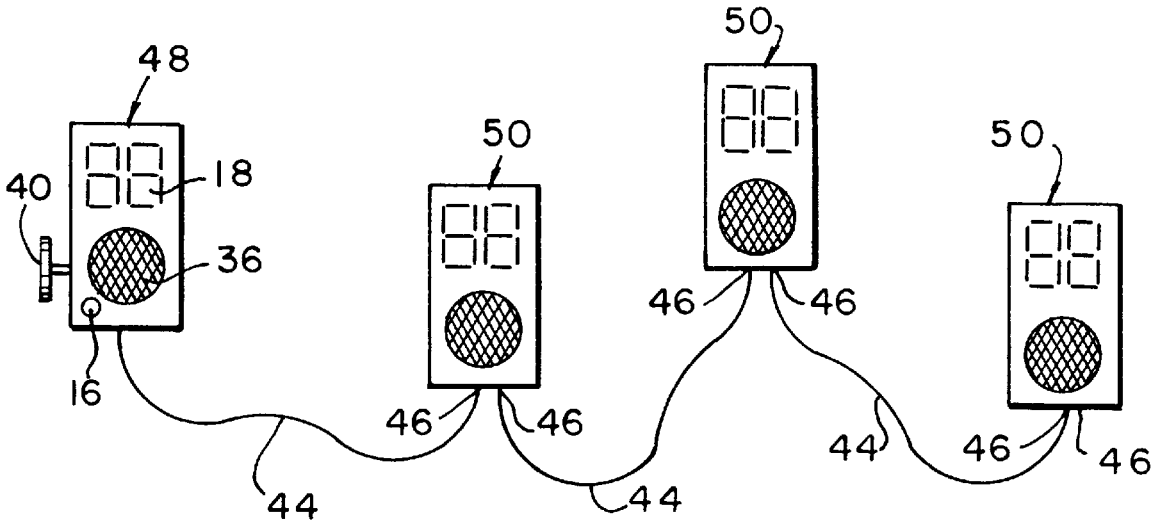
FIG. 6 is a schematic view of a third embodiment of the present invention.

A third embodiment of the electronic game apparatus is exemplarily shown in FIG. 6. In this embodiment, a plurality of wearable units 21 are daisy-chained together. The wearable units —one master or control unit 48 and three slave or subordinate units 50—are electrically connected to each other via a cable 44. The master unit 48 may include a pushbutton 40, for synchronously activating and deactivating all units at the beginning and end of the play period, which may be predetermined by the players with reference to a clock or song from an external source. Alternatively, the master unit 48 may include a variable timer 16 for providing a user-definable play period or, alternatively, the play period may be of fixed duration, say 30 or 60 seconds. As shown, master unit 48 and slave units 50 may each include a speaker 36 and a display 18. When the master unit 48 is disconnected from the slave units 50 the master unit 48 may be employed for solitary play as described hereinabove with reference to FIGS. 1 and 4.

Each slave unit 50 includes two connectors for interconnecting with other units by cables. It will be obvious to persons of ordinary skill in the art from the above disclosure that the number of slave units connected to the master unit 48 may be varied as desired.

Figure 7:
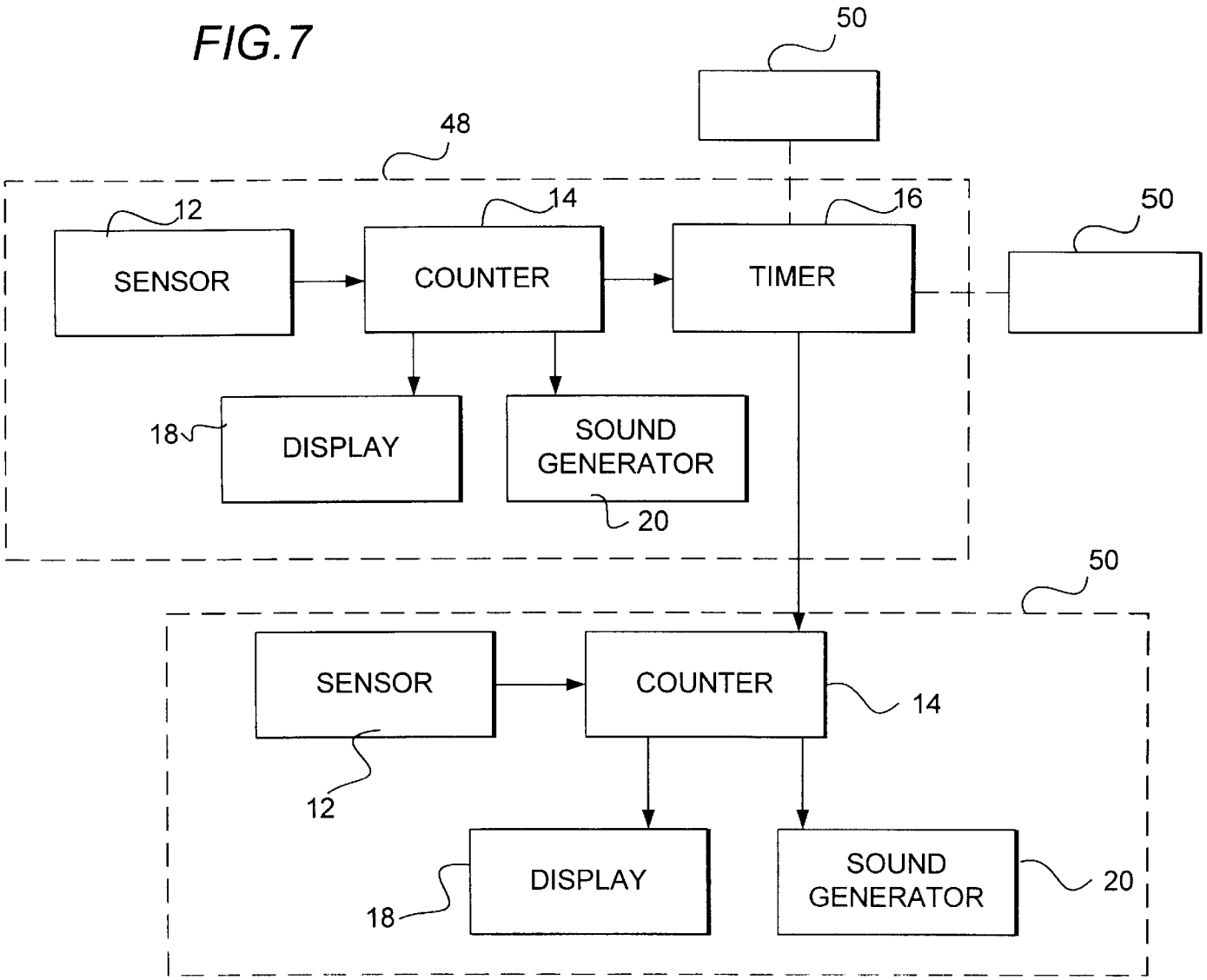
FIG. 7 depicts a functional block diagram of the third embodiment of the present invention.

FIG. 7 is a functional block diagram of the embodiment of FIG. 6. As shown, the timer 16 of the master unit 48 is used to synchronize the counters 14 of the slave units 50.

Although the various embodiments described hereinabove include a visual display 18, the wearable unit 21 may also or alternatively include components and devices for audibly communicating a player's score such as, for example, a voice-synthesizing integrated circuit connected to the speaker 36. Thus, a player's score can be "announced" at the end of a play period or audibly counted during play.

In accordance with a method of playing a child's game using any of the above-described embodiments, the player or players secure wearable units 21 to a selected bodily part, such as an ankle. The duration of the play period is then selected as by selecting theme music of finite duration from an internal or external audio source and/or by setting the timer 16. Once the play period is selected, the wearable units 21 are activated, whereupon the players try to move the selected bodily part as rapidly as possible, with each oscillatory movement being recorded by the counters 14. These movements are continually recorded until the play period ends, which may be signified in any of the ways described above. At the end of the play period the player having the highest score is the winner. For group play, each game may be defined by one or more play periods. For example, the players may decide that a game will consist of five play periods and the winner will be the player having the highest total score at the end of the last play period. Alternatively, players may form teams and total the scores from the team players to determine the winning team. For play with a single wearable unit, a plurality of play periods define each game, with one or several players wearing the same wearable unit during successive play periods. Solitary play is also possible, with the player "competing" against herself for the highest score. It will be obvious to persons of ordinary skill in the art that still numerous other variations in the method of play are possible without deviating from the spirit and scope of the present invention.

While there have shown and described and pointed out fundamental novel features of the invention as applied to several preferred embodiments thereof, it will be understood that various omissions, substitutions and changes in the form and details of the devices and methods disclosed herein may be without departing from the spirit and scope of the invention. For example, it is expressly intended to include all substitute elements and/or method steps which perform substantially the same function in substantially the same way to achieve substantially the same results as the elements and method steps disclosed herein. It is likewise intended that features mentioned in connection with any of the embodiments may also be applied, insofar as practicable, to every other embodiment.

I claim:

1. A method of playing a game, comprising the steps of:

(a) releasably attaching a shake sensor for detecting movements to a bodily part of a player;

(b) detecting with said shake sensor movements imparted to the bodily part of said player;

(c) counting the number of said movements of said bodily part detected by said shake sensor over a predetermined interval of time; and (d) outputting a score to the player indicative of the number of movements counted in step (c).

2. The method of claim 1, further comprising the step of generating an audible tone corresponding to each detected movement.

3. The method of claim 1, wherein said predetermined interval of time is fixed by a music theme of finite duration.

4. The method of claim 1, wherein said predetermined interval of time is fixed by an alarm generated at the beginning and the end of the predetermined interval of time.

5. The method of claim 1, wherein the predetermined interval of time includes a plurality of successive predetermined intervals of time.

6. The method of claim 1, further comprising the step of displacing a moveable object in accordance with said detected movements.

7. The method of claim 1, further comprising the steps of displaying an image of a moveable object and causing the moveable object image to move in accordance with said detected movements.

8. The method of claim 1, further comprising the steps of:

(e) releasably attaching to a bodily part of a second player a second shake sensor for detecting movements;

(f) detecting with said second shake sensor movements imparted to the bodily part of said second player;

(g) counting the number of said movements of said bodily part of said second player detected by said second shake sensor over said predetermined interval of time; and (h) outputting a second score indicative of the number of movements counted in step (g).

* * * * *